US005230389A

United States Patent [19]

Besson

[11] Patent Number: 5,230,389

[45] Date of Patent: Jul. 27, 1993

[54] FLUIDIC OSCILLATOR DRILL BIT

[75] Inventor: Alain Besson, Sartrouville, France

[73] Assignee: Total, Puteaux, France

[21] Appl. No.: 859,457

[22] PCT Filed: Nov. 26, 1990

[86] PCT No.: PCT/FR90/00849

§ 371 Date: Jun. 24, 1992

§ 102(e) Date: Jun. 24, 1992

[87] PCT Pub. No.: WO91/08371

PCT Pub. Date: Jun. 13, 1991

[30] Foreign Application Priority Data

Dec. 1, 1989 [FR] France ..... 89 15871

[51] Int. Cl.[5] ..... E21B 7/24; F15C 1/16; F15C 1/08

[52] U.S. Cl. ..... 175/56; 175/393; 137/813; 137/826

[58] Field of Search ..... 175/56, 393, 249; 137/804, 810, 811, 813, 826, 838

[56] References Cited

U.S. PATENT DOCUMENTS 3,405,770 10/1968 Galle .
3,532,174 10/1970 Diamantides .
3,610,347 10/1971 Diamantides ..... 175/56
4,445,580 5/1984 Sahley ..... 175/404
4,630,689 12/1986 Galle et al. ..... 175/56
4,979,577 12/1990 Walter ..... 175/56
5,009,272 4/1991 Walter ..... 175/56
5,165,438 11/1992 Facteau et al. ..... 137/811 X

FOREIGN PATENT DOCUMENTS 171852 2/1986 European Pat. Off. .
2352943 12/1977 France .
2399530 3/1979 France .

*Primary Examiner*—Ramon S. Britts
*Assistant Examiner*—Roger J. Schoeppel
*Attorney, Agent, or Firm*—Sughrue, Mion, Zinn, Macpeak and Seas

[57] ABSTRACT

A drilling bit having an irrigation system which uses an irrigating fluid. The bit comprises a hollow drill head 14 housing at least one fluidic oscillator 23, 23' which includes an accelerator nozzle 26, 26' supplied by said fluid and opening into a cavity 46, 46' in which a dividing element 34, 34' is mounted which is provided with a ridge 36, 36' located slightly downstream from the nozzle. Said dividing element defines in said cavity two passages 42, 44, 42', 44' towards which the fluid is alternately directed in pulsed jets. Said passages are linked respectively to two series of channels 16 to 22 which open onto the outer surface of the head 14 through a plurality of outlet openings 21 which are oriented so that the pulsed jets they give out are directed to selected portions of the head that need to be cleaned, cooled or lubricated.

10 Claims, 2 Drawing Sheets

FIG. 2
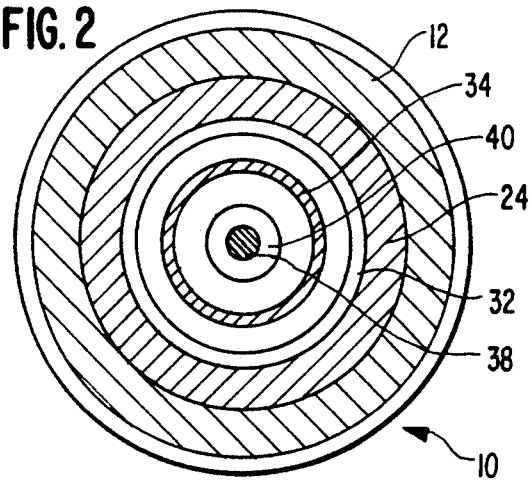
FIG. 3
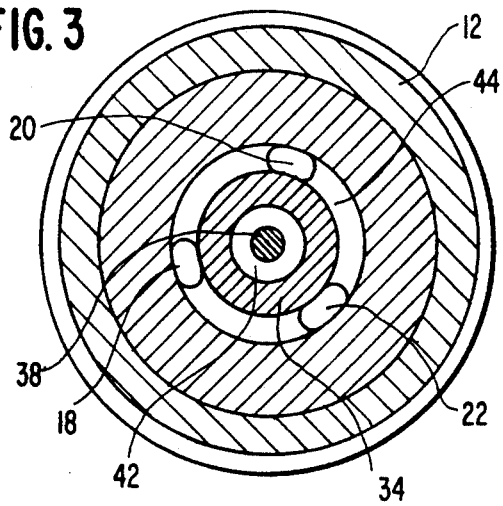
FIG. 5
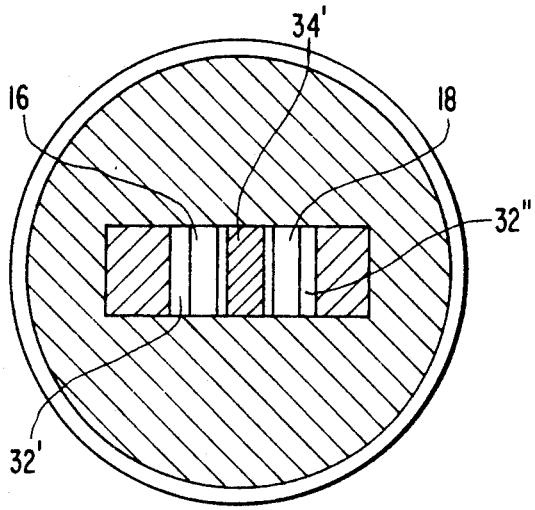
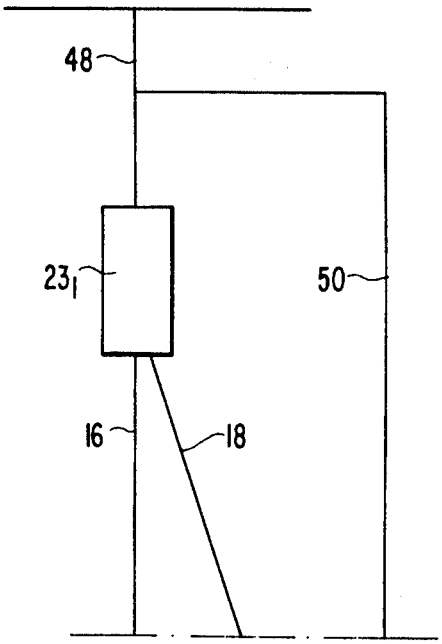
FIG. 6
FIG. 7
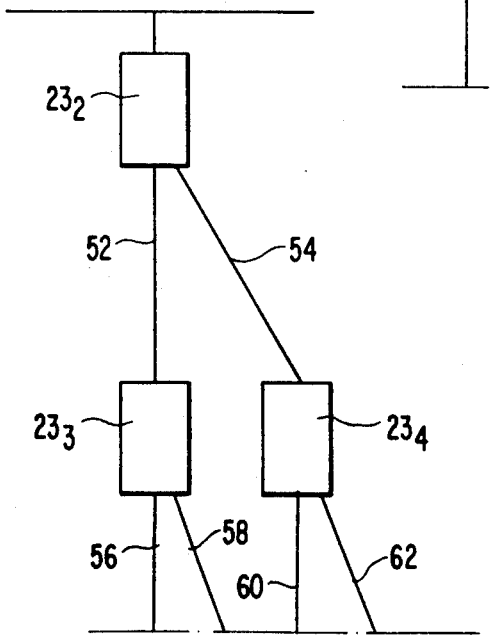

FLUIDIC OSCILLATOR DRILL BIT

The present invention concerns a rotating tool equipped with an irrigation system making it possible to clean the tool with a fluid distributed by a fluidic oscillator. The invention is applicable, in particular, to oil well or mining drilling tools.

As is well known, a fluidic oscillator makes it possible to switch over a fluid flow passing through it in alternating fashion between two different directions, according to a frequency which is a function of the fluid-delivery rate and of the physical characteristics of the oscillator.

Among the most conventionally-used fluidic oscillators, mention may be made of Coanda-effect monostable oscillators, which normally comprise a feed nozzle emptying into a chamber distributing the fluid flow in two possible directions delineated between concentric surfaces. These latter are shaped so that the fluid is channelled in stable fashion in one of them, thereby favoring flow in one of the directions. This flow can be switched to the other direction when acted upon by an external force generating a low level of energy. Because flow in the new direction is unstable, it tends to switch back spontaneously to the stable direction when the force thus exerted is halted.

There also exist bistable Coanda-effect oscillators, in which the flow adheres in stable fashion to the two oscillator surfaces. In this case, an external force must be generated at the moment of each alternation so as to switch the flow from one direction to the other.

In addition, fluidic oscillators are known which operate according to the principle underlying a whistle, i.e., by means of the natural phenomenon of spontaneous vibration of air on either side of a rigid part which is pointed or ends in an edge.

The present invention concerns the application of fluidic oscillators to the irrigation of rotating tools, and, more specifically, to drilling tools comprising a head through which at least two ducts opening onto the surface of the head are drilled.

Patent No. FR-A-2 399 530 discloses a drilling tool equipped with a percussive weight mounted so as to move freely in a casing, and with a fluidic oscillator which drives this weight in an alternating, vibratory motion. However, this tool is not equipped with an irrigation system allowing its critical areas to be cleaned and cooled.

U.S. Pat. No. 3,405,770 concerns a drilling tool in which a fluid is subjected to a pressure-reduction cycle in the area of the drilling shaft, and, simultaneously, to increases in the speed of the fluid ejected. The fluid attacks the rock, but is not used to clean the tool.

U.S. Pat. No. 3,630,689 also concerns a drilling tool comprising a fluidic oscillator designed to generate phase-shifted fluctuations in the pressure in the two ducts. Here again, the jets of fluid are used to attack the rock, but not to clean the tool.

U.S. Pat. Nos. 3,532,174 and 3,610,347 disclose, furthermore, impact drilling tools. However, no means are provided for cleaning the tool.

Patent No. FR-A-2 352 943 concerns a drilling tool in which the fluid is emitted against the rock as two pressurized pulsed jets, in order to force the drilling debris to the outside of the well.

Finally, conventional practice makes use of a system for irrigating a drilling tool through a network of ducts drilled in the tool. The outlets of these ducts are fitted with nozzles suitably aimed for spraying, either directly or indirectly on selected portions of the tool, e.g., on the cutting edges, continuous streams of fluid capable of lifting away the rock and mud particles which adhere to them.

However, this irrigation system retains relative effectiveness to the extent that, since the total fluid discharged is divided among the nozzles, the force of each jet represents only a fraction of the total force of the fluid; as a result, the individual jets are sometimes too weak to clean the tool completely or to wash the critical areas.

Patent No. EP-0 171 852 concerns a drilling tool in accordance with the preface to claim 1. This tool is equipped with a filtering element making it possible to capture the particles of matter propelled by the fluid, the diameter of this element being greater than that of the holes formed on the wall of the tool. This tool has the same disadvantage as the preceding one, since the entire flow of fluid is divided among the entire group of holes, in order to produce continuous jets of fluid. The individual strengths of these jet are too weak to ensure that all of the tool components are cleaned.

The invention concerns a drilling tool fitted with an irrigation system free of the problems associated with the prior state of the art mentioned above.

The invention concerns a drilling tool according to the portion of claim 1 which characterizes it.

One advantage of the irrigation system according to the invention lies in the fact that fluid flow is switched from one duct to the other many times per second, and that, at the moment of each switching operation, all or virtually all of the fluid flow enters the corresponding duct. As a result, given a single usable outlet section, the energy of impact obtained using the system according to the invention will be double that produced using conventional systems, in which the total fluid flow is divided among the outlets.

Another advantage of the invention lies in the fact that it becomes possible to increase the usable outlet section without impairing the quality of the cleaning of the areas selected. Furthermore, alternating pulses emitted at a relatively high frequency are more effective than a continuous stream.

Two shoulders whose concave surfaces face the nozzle are advantageously produced on the walls of said ducts, so that each of them can intercept a portion of the fluid flow in the corresponding duct and channel it to the other duct.

According to one embodiment of the invention, the accelerator nozzle has an annular section, and the divider element is tubular and incorporates a tapered outer face which widens in the direction of flow of the fluid, and a lower tapered face which narrows in the direction of flow, said faces delimiting, at the upper end of the divider element, a circular edge having the same diameter as the outlet orifice of the nozzle and coaxial with the latter.

In a simpler embodiment, the nozzle has a rectilinear outlet slot, and the divider element has the shape of a dihedron incorporating a rectilinear edge.

The irrigation system according to the invention allows cleaning of the blades, cutting edges, diamonds, or other cutting components of diamond tools, cutter wheels, teeth, or gads belonging to tricone tools, etc.

According to the invention, the pulse frequency can be increased, and hydraulic effects which improve washing (alternating crossed jets, jets having different frequencies) can be produced by using several fluidic oscillators mounted in a cascade arrangement.

The invention will now be described with reference to the attached, drawings, provided as non-limiting examples, in which:

FIG. 2 is a cross-section along line II—II in FIGS. 1;

FIG. 3 is a cross-section along line III—III in FIG. 1;

FIG. 5 is a cross-section along line V—V in FIG. 4;

FIG. 6 illustrates diagrammatically an oscillator assembly making it possible to produce two alternating jets and one continuous jet; and FIG. 7 represents diagrammatically an irrigation system incorporating three fluidic oscillators making it possible to increase the frequency of the alternating jets.

Figure 1:
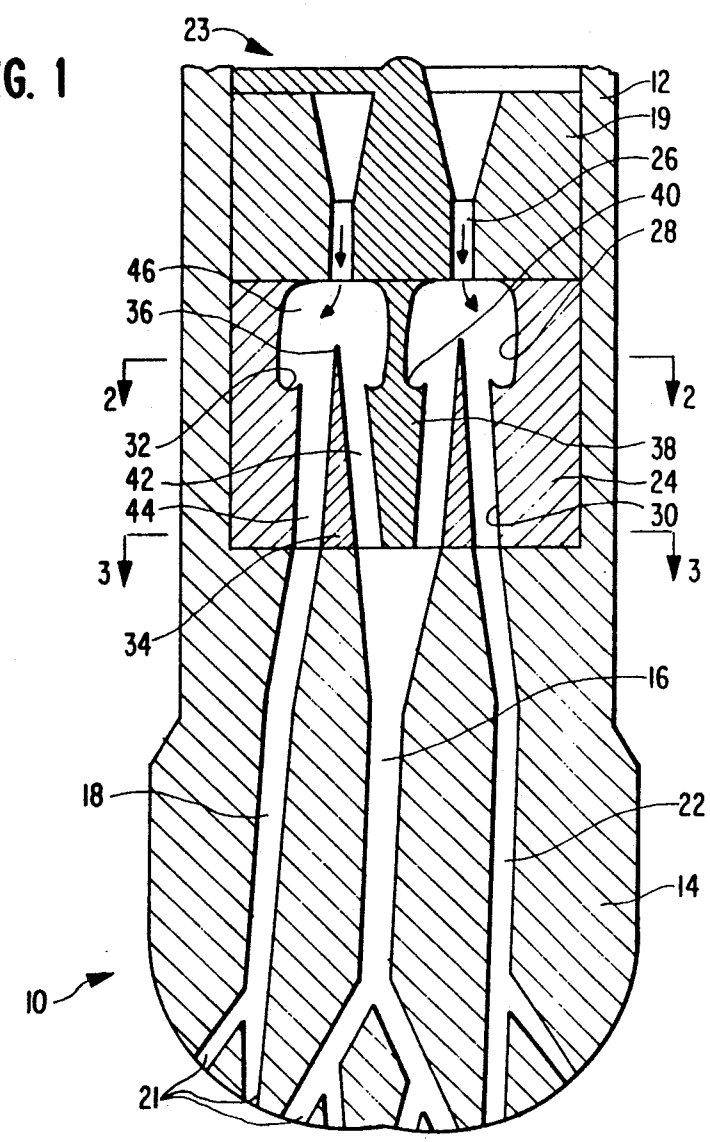
FIG. 1 is an axial cross-section of a drilling tool according to a first embodiment.

In FIGS. 1 to 3, a rotating drilling tool is referenced as 10. This tool comprises a tubular portion 12 attached to a drive element (not shown), and a drill head 14 having, on its surface, excavation elements which may adopt a wide variety of shapes. The head is drilled with a multiplicity of ducts for circulation of an irrigation fluid; for example, a central duct 16 parallel to the axis of the tool and three lateral ducts 18, 20, 22 distributed uniformly around the central duct. These ducts can branch out near their ends, so as to empty through several groups of outlet orifices 21 which are suitably positioned so as to spray jets of fluid toward the selected parts of the tool which especially require washing, cooling, or lubrication. The outlet orifices may be equipped with nozzles.

A fluidic oscillator 23 composed of two superposed cylindrical bodies 19, 24 is inserted in the tool. The upper body 19 is fitted with a tubular accelerator nozzle 26, through which the fluid is delivered. The lower body 24 is tubular and its upper part comprises a cylindrical bore 28 having a relatively large diameter, followed by a bore 30 whose diameter is smaller and which widens in the direction of flow. These two bores delimit, between them, an annular shoulder 32 facing the nozzle.

A tubular divider element 34 whose outer tapered surface widens in the direction of flow and whose lower tapered surface narrows in the direction of flow is attached coaxially in the lower bore 30 of the body, for example using connecting bridges (not shown in FIG. 1). At its upper end, the divider element ends in a circular edge 36 whose diameter is equal to that of the annular outlet orifice in the nozzle 26. This edge is coaxial with this orifice and is positioned slightly downstream from it and above the level of the shoulder 32.

A central core 38 extending along the full height of the lower body 24 is mounted coaxially in the cavity of the divider element 34. This core has an inner annular shoulder 40 facing the nozzle and positioned on the same level as the outer shoulder 32. Beneath the shoulder 40, the core is shaped like a truncated cone and has the same amount of taper as the outer surface of the divider element. As a result of this design, the divider element delimits, in conjunction with the central core, an inner annular passage 42, and, in conjunction with the lower body 24, an outer annular passage 44. These passages are sized incorporating the diameters as selected, so that they empty into the central duct 16 and the lateral ducts 18, 20, 22, respectively.

It will be noted that the central core 38 can be eliminated and the shoulders 40 formed on the inner tapered wall of the divider element 34.

The system shown in FIGS. 1 to 3 functions in the following way: Drilling sludge is accelerated in the nozzle 26 and empties at high speed into a distribution chamber 46 delimited above the shoulders 32, 40. Because of the vibratory phenomenon explained above, the flow of sludge passes in alternating fashion to the inside of the divider element, through the inner passage 42 to the central duct 16, and then, to the outside of said element, through the passage 44 to the lateral ducts 18, 20, and 22, at a frequency which depends on the rate of flow and on the geometry of the divider element. This vibratory phenomenon is enhanced by the presence of annular shoulders 32, 40, given that their effect is to send a portion of the fluid flow back from one passage to the other. However, the device can also function satisfactorily even in the absence of any shoulder.

Figure 4:
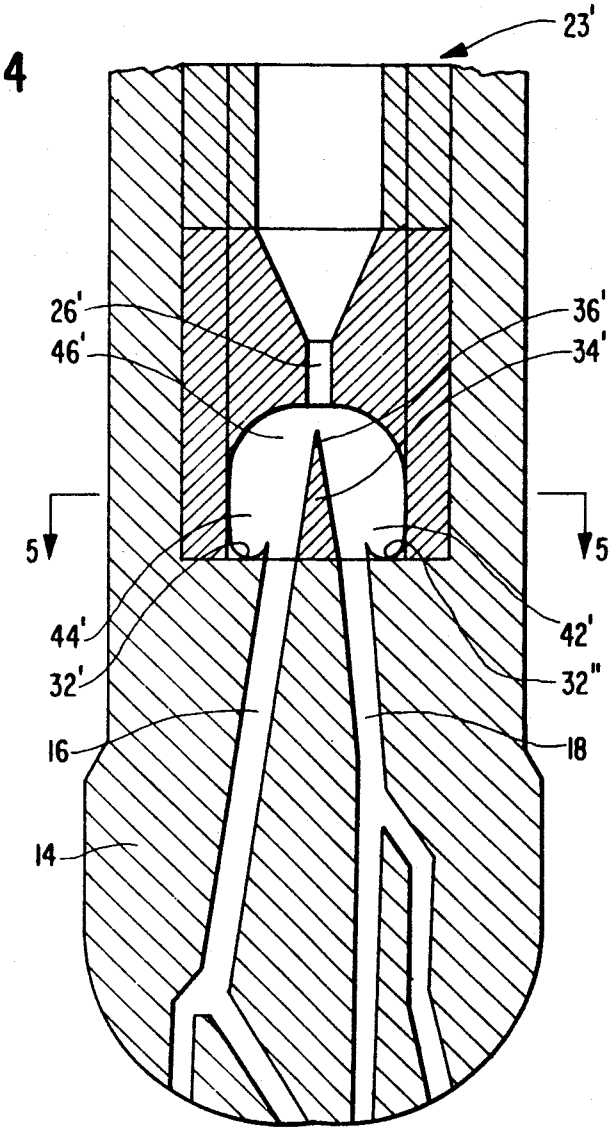
FIG. 4 is an axial cross-section of a drilling tool according to a second embodiment.

In the embodiment shown in FIGS. 4 and 5, the fluidic oscillator 23' comprises a nozzle 26' having a square or rectangular section and a rectilinear outlet slot which empties into the V-shaped distribution chamber 46', whose walls incorporate two parallel shoulders 32', 32''. This cavity houses a divider element 34' in the shape of a dihedron with a rectilinear edge 36' delimiting two passages 42' and 44' connecting with the ducts 16, 18, respectively, in the tool.

The operation of the oscillator is similar to that in FIG. 1. Here also, the shoulders 32', 32'' channel a portion of fluid flow from one passage to the other, thus enhancing the vibratory phenomenon.

It will be noted that a fluidic oscillator may be produced in which one of the passages receives more fluid than the other, by slightly offsetting the divider element 34 or 34' in relation to the axis of the nozzle. In this case, the flow in the passage receiving the greater part of the fluid is only partially tilted toward the other passage. Consequently, the nozzles connected to said passage receive a constant flow, to which a variable flow is added, thereby generating alternating jets.

In one embodiment of the invention, instead of mounting a single oscillator inside the tool, several oscillators, in the form of directed nozzles, may be respectively positioned in a movable configuration in the orifices 21. Alternating irrigation incorporating multidirectional flow can thus be produced.

The hydraulic system shown in FIG. 6 comprises a fluidic oscillator $23_1$ of one of the types described above. The oscillator is fed with drilling sludge through a duct 48 and emits, through several ducts (e.g., two ducts 16, 18), two alternating, intermittent jets. A portion of the flow of drilling sludge is drawn off upstream from the oscillator through a duct 50, so as to be channelled to an area requiring continuous irrigation. The assembly comprising all of these components is incorporated into the tool (not shown for purposes of simplification).

An irrigation system comprising several oscillators mounted in a cascade arrangement can also be produced. For example, the system in FIG. 7 comprises a first fluidic oscillator $23_2$ which emits two intermittent, alternating jets through two ducts 52, 54, respectively connected to two fluidic oscillators $23_3$, $23_4$. Each of these jets is, accordingly, transformed into two jets having a higher frequency and emitted through the ducts 56, 58, for oscillator $23_3$, and through ducts 60, 62, for oscillator $23_4$. If the three oscillators are identical, jets having a frequency double that of the jets emitted from oscillator $23_2$ may be generated at the outlets of the oscillators $23_3$, $23_4$. Here again, the assembly comprising the oscillators and the ducts is incorporated inside the tool.

Of course, the ducts 56 to 62, or some among them, can feed, in turn, other oscillators. An irrigation system composed of two, three, or more stages of oscillators supplying intermittent jets having different frequencies can thus be built.

Modifications may be made to the embodiments described, while remaining within the scope of the invention. For example, the divider element in FIG. 1 may be quite simply tubular, without exhibiting inner and outer tapers. Similarly, the divider element in FIG. 4 can be formed from a single wall having parallel, or substantially parallel faces.

I claim:

1. Drilling tool incorporating an irrigation system designed to clean, cool or lubricate selected parts of the tool, of the type comprising a hollow drill head drilled with two series of ducts opening on the outer surface of the head through a multiplicity of outlet holes equipped with nozzles and capable of spraying jets of fluid in different directions, wherein the drill head (14) houses at least one fluidic oscillator (23; 23') comprising an accelerator nozzle (26; 26') fed with said fluid and emptying into a cavity (46; 46') which houses a divider element (34; 34') fitted with an edge (36; 36') positioned slightly downstream from the nozzle, said divider element delimiting, in said cavity, two passages (42, 44; 42'; 44') which connect, respectively, with said series of ducts (16; 18, 20, 22) and to which all of the fluid flow is channelled in alternating fashion in pulsed jets, as a result of the natural vibrations of the fluid caused by the divider element (34; 34').

2. Drilling tool according to claim 1, wherein two shoulders (32, 40; 32', 32'') whose concave surfaces face the nozzle are formed, respectively, on the walls of said passages (42, 44; 42', 44'), so that each shoulder can intercept a portion of the fluid flowing in the corresponding passage and direct it to the other passage.

3. Irrigation system according to either of claims 1 and 2, wherein the accelerator nozzle (26) has an annular section and the divider element (34) is tubular and has an outer tapered surface which widens in the direction of flow of the fluid, and an inner tapered surface which narrows in the direction of the flow, the divider element ending slightly downstream from the nozzle orifice in a circular edge (36) having the same diameter as said orifice and coaxial with it, a central core (38) being mounted concentrically inside of the divider element (34) so as to delimit within said element an inner annular passage (42), the walls of the cavity (46) and of the core (38) incorporating, respectively, an outer annular shoulder (32) and an inner annular shoulder (40) whose concave surfaces face the nozzle.

4. Drilling tool according to either of claims 1 and 2, wherein the divider element is tubular and has an outer tapered wall which widens as it extends downstream and an inner tapered wall which narrows as it extends downstream, an inner annular shoulder and an outer annular shoulder being formed on the inner tapered wall of the divider element and on the wall of the cavity (46), respectively.

5. Drilling tool according to either of claims 1 and 2, wherein the nozzle (26') incorporates a rectilinear outlet slot and wherein the divider element (34') is V-shaped and has a rectilinear edge (36'), the walls of the cavity (46) comprising, respectively, two shoulders (32', 32'') whose concave surfaces face the nozzle.

6. Drilling tool according to either of claims 1 and 2, wherein the divider element is formed from a tubular element whose outer and inner walls do not incorporate a concave surface.

7. Drilling tool according to claim 5, wherein the divider element is formed from a flat partition having parallel, or substantially parallel, surfaces.

8. Drilling tool according to either of claims 1 and 2, wherein the divider element (34; 34') is centered exactly on the axis of the nozzle (26,26') or is slightly offset in relation to said axis.

9. Drilling tool according to claim 1, wherein said tool incorporates a fluidic oscillator ($23_1$) which emits at least two alternating, intermittent jets, a portion of the fluid flow being drawn off upstream from oscillator through a duct (50) so as to be channelled to an area of the tool requiring continuous irrigation.

10. Drilling tool according to either of claims 1 and 2, wherein said tool comprises at least two stages of oscillators mounted in a cascade arrangement and comprising a first fluidic oscillator ($23_2$) which emits two intermittent, alternating jets through two ducts (52, 54), which are connected, respectively, to the inlets of at least two other fluidic oscillators ($23_3$, $23_4$), each of these latter emitting, in turn, at least two jets of fluid whose frequency is higher than that of the jets which feed it, these jets, or some of them, being capable of functioning in turn in order to feed one or several other fluidic oscillators.

* * * * *